US007874811B2

(12) United States Patent
Kieninger et al.

(10) Patent No.: US 7,874,811 B2
(45) Date of Patent: Jan. 25, 2011

(54) SUCTION JET PUMP

(75) Inventors: Klemens Kieninger, Liederbach (DE); Michael Teichert, Schwalbach (DE)

(73) Assignee: Siemens Aktiengesellschaft, München (DE)

( * ) Notice: Subject to any disclaimer, the term of this patent is extended or adjusted under 35 U.S.C. 154(b) by 1183 days.

(21) Appl. No.: 10/523,752

(22) PCT Filed: Jun. 30, 2003

(86) PCT No.: PCT/DE03/02166

§ 371 (c)(1),
(2), (4) Date: Feb. 8, 2005

(87) PCT Pub. No.: WO2004/018864

PCT Pub. Date: Mar. 4, 2004

(65) Prior Publication Data

US 2005/0241621 A1 Nov. 3, 2005

(30) Foreign Application Priority Data

Aug. 9, 2002 (DE) ..... 102 37 050

(51) Int. Cl.
*F04B 23/08* (2006.01)
*F02M 37/04* (2006.01)
*F04F 5/00* (2006.01)

(52) U.S. Cl. ..... 417/88; 123/509; 123/514; 137/565.22

(58) Field of Classification Search ..... 417/88, 417/151, 175, 176; 123/509, 510, 468, 514; 137/565.22
See application file for complete search history.

(56) References Cited

U.S. PATENT DOCUMENTS

| | | | | |
|---|---|---|---|---|
| 4,768,925 | A * | 9/1988 | Geupel | 415/213.1 |
| 4,834,132 | A | 5/1989 | Sasaki et al. | |
| 4,838,307 | A * | 6/1989 | Sasaki et al. | 137/574 |
| 5,024,583 | A * | 6/1991 | Sasaki et al. | 417/198 |
| 5,082,426 | A * | 1/1992 | Sasaki et al. | 417/198 |
| 5,133,324 | A * | 7/1992 | Michiaki | 123/514 |
| 5,139,000 | A * | 8/1992 | Sawert | 123/514 |
| 5,218,942 | A * | 6/1993 | Coha et al. | 123/514 |
| 5,289,810 | A * | 3/1994 | Bauer et al. | 123/510 |
| 5,392,750 | A | 2/1995 | Laue et al. | |
| 5,396,872 | A * | 3/1995 | Ruger et al. | 123/514 |
| 5,402,558 | A | 4/1995 | Santapa | |
| 5,527,163 | A * | 6/1996 | Werkmann et al. | 417/181 |

(Continued)

FOREIGN PATENT DOCUMENTS

CN 1338026 A 2/2002

(Continued)

OTHER PUBLICATIONS

Chinese Office Action Dated Apr. 6, 2007, 6 pages.

*Primary Examiner*—Charles G Freay
(74) *Attorney, Agent, or Firm*—Cohen Pontani Lieberman & Pavane LLP

(57) ABSTRACT

A suction jet pump with a propulsion jet nozzle, a mixing tube, a suction port and a suction line attached thereto, wherein at least part of the mixing tube is arranged in a pot. The suction jet pump is used to supply fuel in a fuel container or from a fuel container in a swirl pot that is arranged inside the fuel container.

15 Claims, 5 Drawing Sheets

U.S. PATENT DOCUMENTS

| | | | | |
|---|---|---|---|---|
| 5,732,684 | A * | 3/1998 | Thompson | 123/514 |
| 5,797,373 | A * | 8/1998 | Kleppner et al. | 123/495 |
| 6,113,354 | A * | 9/2000 | Meese et al. | 417/199.1 |
| 6,123,511 | A * | 9/2000 | Sertier | 417/87 |
| 6,276,342 | B1 * | 8/2001 | Sinz et al. | 123/514 |
| 6,283,142 | B1 * | 9/2001 | Wheeler et al. | 137/265 |
| 6,293,256 | B1 | 9/2001 | Kleppner et al. | |
| 6,296,454 | B1 | 10/2001 | Schmid et al. | |
| 6,371,153 | B1 * | 4/2002 | Fischerkeller et al. | 137/265 |
| 6,425,378 | B1 | 7/2002 | Frank | |
| 6,453,884 | B2 * | 9/2002 | Ushigome | 123/509 |
| 6,488,476 | B2 * | 12/2002 | Eck | 417/76 |
| 6,598,594 | B2 * | 7/2003 | Takahashi | 123/514 |
| 6,607,005 | B2 * | 8/2003 | Viebahn et al. | 137/574 |
| 6,619,927 | B1 | 9/2003 | Becker et al. | |
| 6,708,673 | B2 * | 3/2004 | Herzog et al. | 123/509 |
| 6,712,590 | B1 * | 3/2004 | Villela et al. | 417/423.9 |
| 6,840,230 | B2 * | 1/2005 | Ichikawa et al. | 123/509 |
| 6,907,899 | B2 * | 6/2005 | Yu et al. | 137/565.22 |
| 2001/0055530 | A1 * | 12/2001 | Eck | 417/87 |
| 2002/0083983 | A1 | 7/2002 | Coha et al. | |
| 2002/0112700 | A1 * | 8/2002 | Iwamoto et al. | 123/509 |
| 2003/0213477 | A1 * | 11/2003 | Ramamurthy et al. | 123/509 |
| 2004/0074995 | A1 * | 4/2004 | Okada | 239/533.1 |
| 2004/0237941 | A1 * | 12/2004 | Sinz | 123/509 |

FOREIGN PATENT DOCUMENTS

| | | | | |
|---|---|---|---|---|
| DE | 37 32415 | A1 | | 4/1988 |
| DE | 42 42 242 | C2 | | 6/1994 |
| DE | 44 26 685 | A1 | | 3/1995 |
| DE | 43 36 060 | A1 | | 4/1995 |
| DE | 195 04 217 | A1 | | 8/1996 |
| DE | 198 55 433 | A1 | | 6/2000 |
| DE | 43 28 198 | C2 | | 2/2001 |
| DE | 199 57 066 | A1 | | 5/2001 |
| EP | 1 378 670 | | * | 6/2003 |
| JP | 62191658 | | | 8/1987 |
| JP | 05-99090 | | * | 4/1993 |
| WO | WO 99/61777 | | | 12/1999 |
| WO | WO 01/38719 | A1 | | 5/2001 |

* cited by examiner

SUCTION JET PUMP

This application is made pursuant to 35 U.S.C. §371 of international application number PCT/DE2003/002166, filed Jun. 30, 2003 with a priority date of Aug. 9, 2002.

FIELD OF THE INVENTION

The subject of the invention is a suction jet pump with a proportion jet nozzle, with a mixing tube, with an intake orifice and with an intake line connected thereto. The suction jet pump serves for conveying fuel within a fuel tank or out of a fuel tank in a baffle which is arranged within the fuel tank.

BACKGROUND OF THE INVENTION

It is known that fuel tanks have many different forms. With the fuel tank being adapted to the motor vehicle, so as to utilize the existing construction space, fuel tanks which are subdivided into a plurality of chambers are obtained.

These chambers are for the most part connected to a saddle. In fuel tanks of this type, there is the problem that, in the case of a low filling level, the fuel can no longer pass out of one chamber over the saddle into the other chamber. Since normally only one conveying unit is arranged in a fuel tank, the fuel located in another chamber cannot reach the conveying unit. In these instances, suction jet pumps are used in order to supply the fuel present in other regions of the fuel tank to the conveying unit or to convey the fuel at least into the chamber or the region in which the conveying unit is located (DE 37 32 415 A1).

Conventional suction jet pumps are arranged at the bottom of the chambers or the regions of the fuel tank out of which the fuel is to be conveyed to the conveying unit. Since the intake orifice of the suction jet pump is arranged at the bottom of the fuel tank, the suction jet pump is always located in the fuel and is therefore always ready for operation. Suction jet pumps of this type have high efficiency. The conveyance factor, that is to say the ratio of the sum jet to the propulsion jet, is at least in the region of seven. The disadvantage, here, is that, with the propellant line to the suction jet pump and the sum line from the suction jet pump, two lines are required which have to be laid and fastened in the fuel tank.

Furthermore, it is known to use sucking suction jet pumps which are arranged in the region of the conveying unit. A suction line leads from the suction jet pump into the region out of which the fuel is to be conveyed. To generate the necessary vacuum in the suction line, the suction jet pump possesses a special propulsion jet nozzle. The outlet orifice of the propulsion jet nozzle is designed as a slit. On account of the slit, the propulsion jet is fanned open after emerging from the propulsion jet nozzle. The fanned-open propulsion jet closes the mixing tube, with the result that the necessary vacuum is generated so that the fuel can be sucked in via the relatively long intake line. On account of this, it is necessary to have instead of two, as hitherto, only one line to be laid and fastened in the fuel tank. This embodiment has the disadvantage of the low conveyance factor of the sucking suction jet pump which is approximately 2. This low conveyance factor is due to the fanning open of the propulsion jet after leaving the propulsion jet nozzle.

The object on which the present invention is based, therefore, is to provide a sucking suction jet pump having an improved conveyance factor. Furthermore, the suction jet pump is to have a simple and compact construction and be easy to mount.

Other objects will become apparent upon a further reading of the following detailed description taken in conjunction with the drawings.

The object is achieved by means of the features of claim 1. Advantageous refinements are contained in the subclaims.

SUMMARY OF THE INVENTION

The suction jet pump according to the invention comprises a propulsion jet nozzle, a mixing tube and an intake orifice connected to an intake line, at least part of the mixing tube being arranged in a pot. By virtue of the conveying medium located in the pot, the mixing tube is sealed off relative to the surroundings. With the mixing tube being sealed off, a vacuum is formed in the suction jet pump and makes it possible for the medium to be conveyed to be sucked in over a wide distance. The advantage of the invention is that, by means of the intake line, only one line is arranged in the fuel tank, and that the suction jet pump possesses a conveyance factor such as conventional suction jet pumps possess. Moreover, because of the high suction action, the suction jet pump is no longer restricted in its arrangement to the bottom region of the fuel tank or of the baffle.

The suction jet pump is advantageously arranged with respect to its axial extent at an angle deviating from the horizontal. The choice of the angle may be made as a function of the existing space conditions in the fuel tank. What has proved especially favorable is the vertical arrangement of the suction jet pump in which the suction jet pump is at an angle to the horizontal of 90° with respect to its axial extent. This vertical arrangement of the suction jet pump is especially space-saving. This position makes it possible to arrange the suction jet pump at or in the baffle of a conveying unit located in the fuel tank. A separate fastening of the suction jet pump to the fuel tank may thereby be dispensed with. Moreover, the suction jet pump can be preassembled together with the conveying unit, tested and subsequently mounted in the fuel tank in one operation step.

In an advantageous refinement, only the outlet orifice of the mixing tube is located in the pot. This makes it possible to have a very flat and therefore relatively small design of the pot.

In a further refinement, the pot is connected to the suction jet pump. The pot may be integrally formed in one piece with the suction jet pump, preferably on the mixing tube. However, the manufacture of the suction jet pump according to the invention is especially simple when the pot is connected to the suction jet pump by means of a latch or plug connection. The pot thereby forms a unit with the suction jet pump. The suction jet pump can consequently be used at any desired locations.

There is an advantageous connection of the pot and suction jet pump when latch or plug elements which engage one into the other are present both on the suction jet pump and on the pot. The pot and the suction jet pump can be connected in an especially simple way when the pot has a groove, into which a tongue integrally formed on the mixing tube engages.

When the suction jet pump is used for filling the baffle, the suction jet pump can convey over the upper edge into the baffle, the suction jet pump advantageously being arranged in the region of the upper edge. The intake orifices hitherto provided in the bottom of the baffle are no longer required. This likewise dispenses with the valve which closes the orifice caused by the suction jet pump when the suction jet pump is not in operation.

The device according to the invention is especially simple when the pot is formed by another component or is integrated into this component. Thus, the pot may be arranged on the baffle. The pot is in this case either integrally formed on the baffle or fastened to the baffle. The baffle used in this case has an especially simple configuration when part of the bottom is divided off so that this divided-off region forms the pot. The baffle may just as well have on its outer wall an integrally formed portion which constitutes the pot for the suction jet pump. The advantage of these refinements is that only the suction jet pump has to be mounted.

BRIEF DESCRIPTION OF THE DRAWINGS

The invention is explained in more detail by means of several exemplary embodiments. Thus, in the figures.

DETAILED DESCRIPTION

Figure 1:
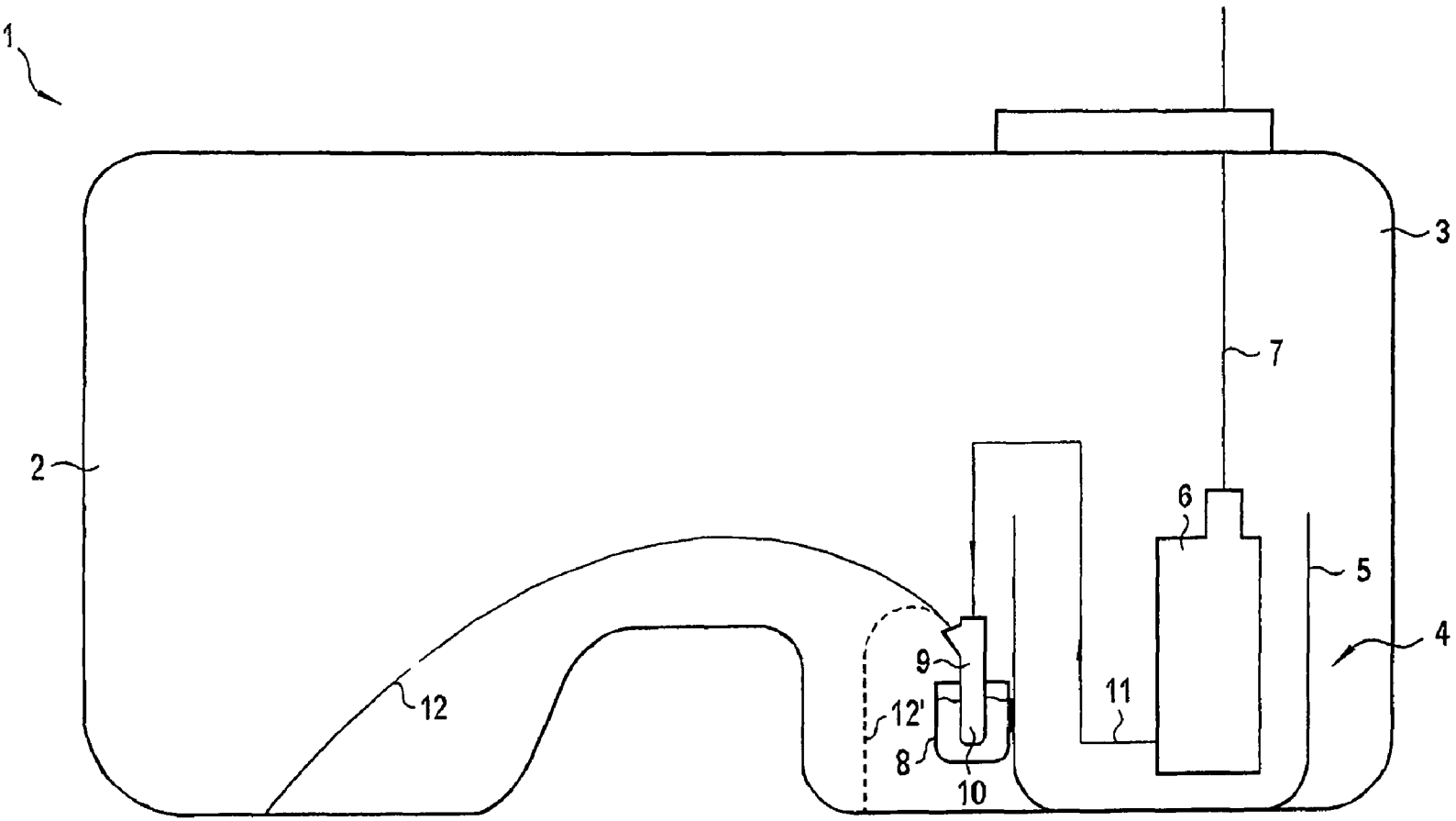
FIG. 1 shows an arrangement of the suction jet pump in a fuel tank.

While the present invention is capable of embodiment in various forms, there is shown in the drawings and will be hereinafter described a presently preferred embodiment with the understanding that the present disclosure is to be considered as an exemplification of the invention, and is not intended to limit the invention to the specific embodiment described and illustrated.

FIG. 1 illustrates a fuel tank 1 comprising two chambers 2, 3. A conveying unit 4 comprising a baffle 5 and a fuel pump 6 arranged therein is fastened in the fuel tank 1. The fuel conveyed by the fuel pump 6 is conducted via a forward-flow line 7 to an internal combustion engine, not illustrated. A pot 8 is fastened to the outer wall of the baffle 5. A suction jet pump 9 is arranged in relation to the pot 8 in such a way that its mixing tube 10 projects into the pot. Fuel is supplied from the fuel pump 6 to the suction jet pump 9 via a line 11. A further line 11 extends from the suction jet pump 9 into the other chamber 2. Fuel is conveyed via the line 12 out of the chamber 2 into the chamber 3 or directly into the baffle 5.

Figure 2C:
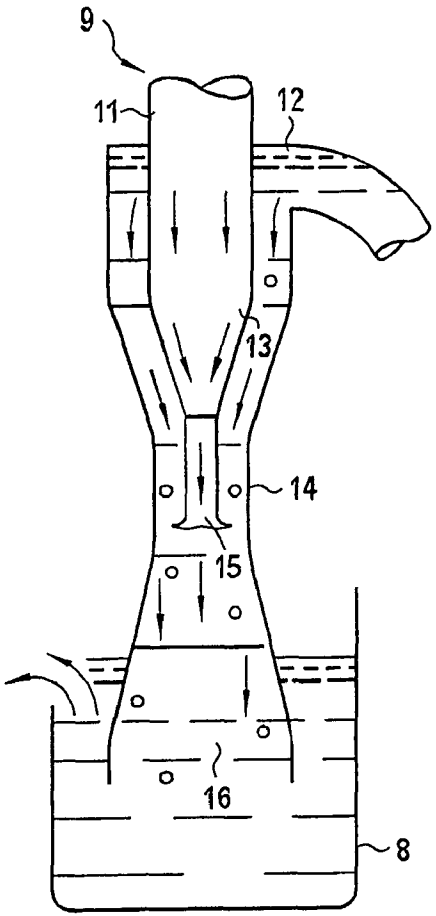
FIG. 2*a-c* show the type of action of the suction jet pump according to the invention.
Figure 2B:
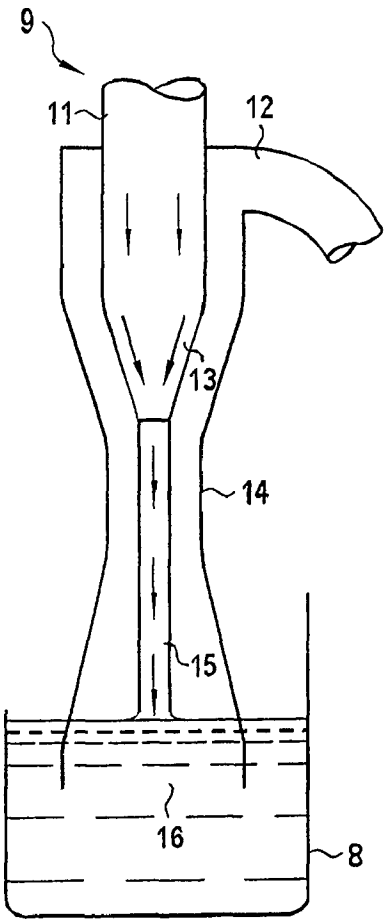
Figure 2A:
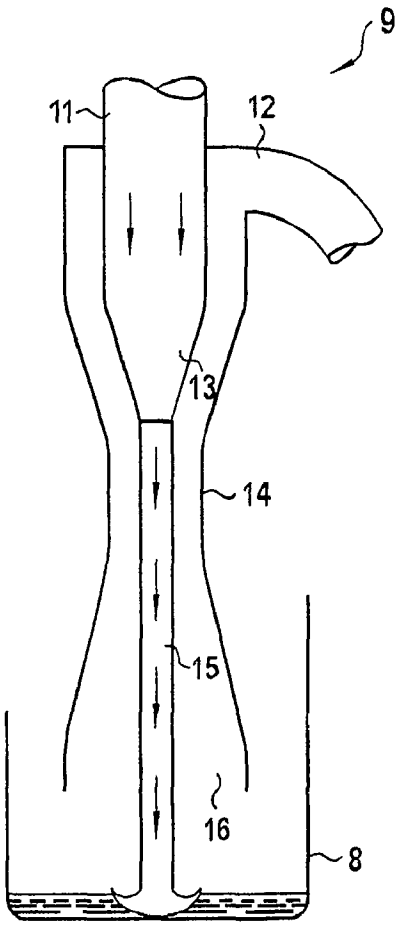

The suction jet pump 9 illustrated in FIGS. 2*a-c* comprises a propulsion jet nozzle 13, a mixing tube 14, the intake line 12 and a pot 8. A propulsion jet 15 is supplied to the suction jet pump 9 by means of the propulsion jet line 11. The propulsion jet 15 emerges through the propulsion jet nozzle 13 and enters the mixing tube 14. The intake line 11 issues into the suction jet pump 9 in the region of the propulsion jet nozzle 13. The suction jet pump 9 is arranged vertically with respect to the axial extent of the mixing tube 14. Furthermore, the suction jet pump 9 is arranged in relation to the pot 8 in such a way that the outlet orifice 16 of the mixing tube 14 penetrates into the pot 8. In the state illustrated in FIG. 2*a*, the pot 8 is filled only slightly with fuel. The propulsion jet 15 passes out of the propulsion jet nozzle 13 via the mixing tube 14 into the pot 8, with the result that the propulsion jet 15 fills the pot 8. The vacuum thus generated in the suction jet pump 9 is in this case not sufficient to convey a relatively large quantity of fuel out of the chamber 2 via the intake line 11.

Owing to the propulsion jet 15 and to the small pot volume, the pot 8 is filled immediately after the start of operation of the suction jet pump 9. With the rising filling level in the pot 8, the outlet orifice 16 of the mixing tube 14 is flooded, so that a liquid closure occurs in the mixing tube 14 and consequently in the suction jet pump 9. This situation is illustrated in FIG. 2*b*. Since the mixing tube 14 is then completely closed, the propulsion jet 15 generates a substantially higher vacuum which, in turn, is sufficient to convey a relatively large quantity of fuel over a relatively long distance into the pot 8 by means of the intake line 11 according to FIG. 2*c*.

Figure 3:
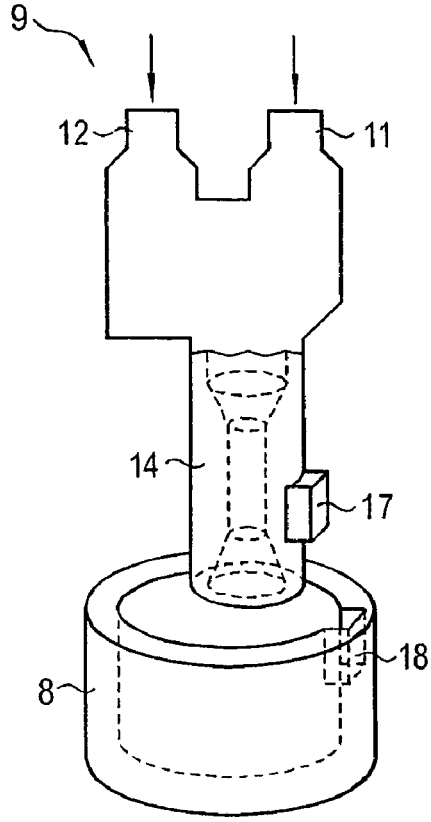

The suction jet pump 9 shown in FIG. 3 is connected to the pot 8 via a plug connection. A tongue 17 is integrally formed on the outside of the mixing tube 14, while the inner wall of the pot 8 has a groove 18 at one point. To connect the pot 8 and the suction jet pump 9, the tongue 17 is pushed into the groove 18. When the lower groove boundary is reached, the suction jet pump 9 is positioned with respect to the pot 8. The suction jet pump 9 is in this case arranged eccentrically with respect to the pot 8. This gives rise to a preferred outflow direction of the fuel from the pot 8, this outflow direction lying opposite to the suction jet pump 9 in relation to the circumference of the pot 8. By virtue of a design of the groove bottom 19 which differs from FIG. 3, in that the groove bottom in this case is at a smaller angle to the horizontal than 90°, the suction jet pump 9 can be arranged at an angle deviating from the vertical with respect to the axial extent of the mixing tube 14.

Figure 4:
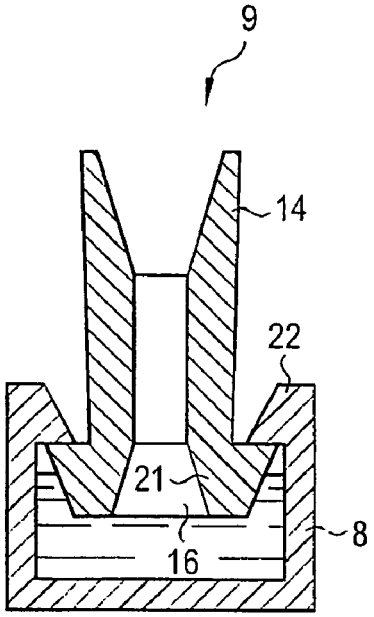
FIG. 3-5 show various arrangements of the suction jet pump in relation to the pot.

FIG. 4 shows a further embodiment for the fastenings of the suction jet pump 9 to the pot 8. Latch elements in the form of latch hooks 21 are integrally formed on the mixing tube 14 in the region of the outlet orifice 16 and cooperate with correspondingly designed latch points 22 which are integrally formed on the pot 8. It is also conceivable to provide the latch hooks 21 on the pot 8, while the mixing tube 14 possesses the necessary latch points 22.

Figure 5:
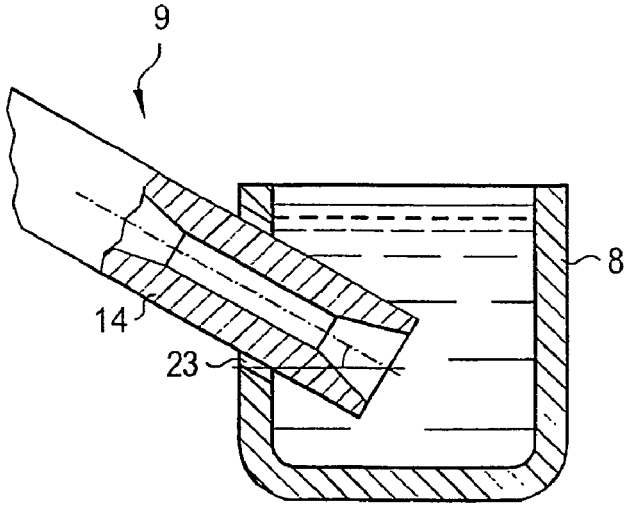

In the illustration according to FIG. 5, the suction jet pump 9 is arranged at an angle of 40° to the horizontal with respect to the axial extent of the mixing tube 14. The mixing tube 14 is set via a bore 23 present in the pot 8. The mixing tube 14 is held in its position by means of the bore 23. The diameters of the mixing tube 14 and of the bore 23 are designed as a press fit. The mixing tube 14 is thereby held reliably in its position. During mounting, the bottom of the pot 8 forms the abutment for the mixing tube 14.

Figure 6:
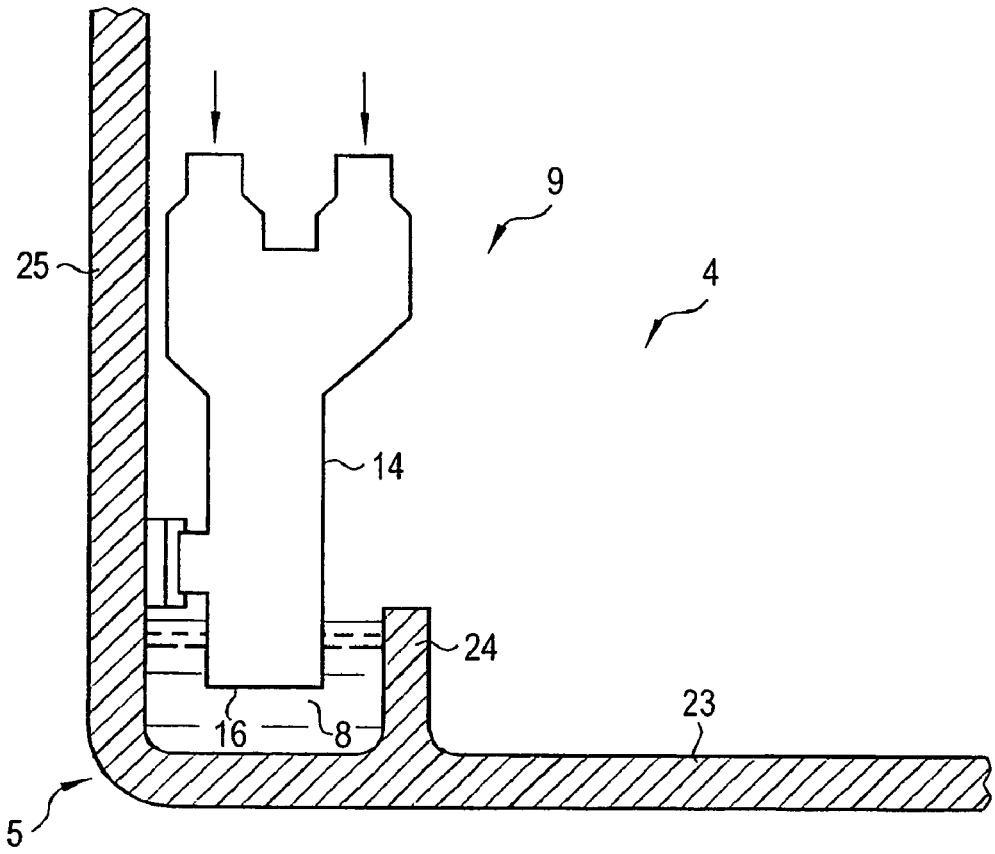
FIGS. 6, 7 show the arrangement of the suction jet pump on a baffle.

In the embodiment shown in FIG. 6, the pot 8 is not a separate component, but an integral part of the baffle 5 of the conveying unit 4. Integrally formed on the bottom 23 of the baffle 5 is a wall 24 which together with the wall 25 of the baffle 5 forms the pot 8. The mixing tube 14 projects with its outlet orifice 16 into the pot 8. The fuel conveyed by the suction jet pump 9 flows out of the pot 8 directly into the baffle 5. The fuel is conveyed from there to the internal combustion engine by the fuel pump, not illustrated.

Figure 7:
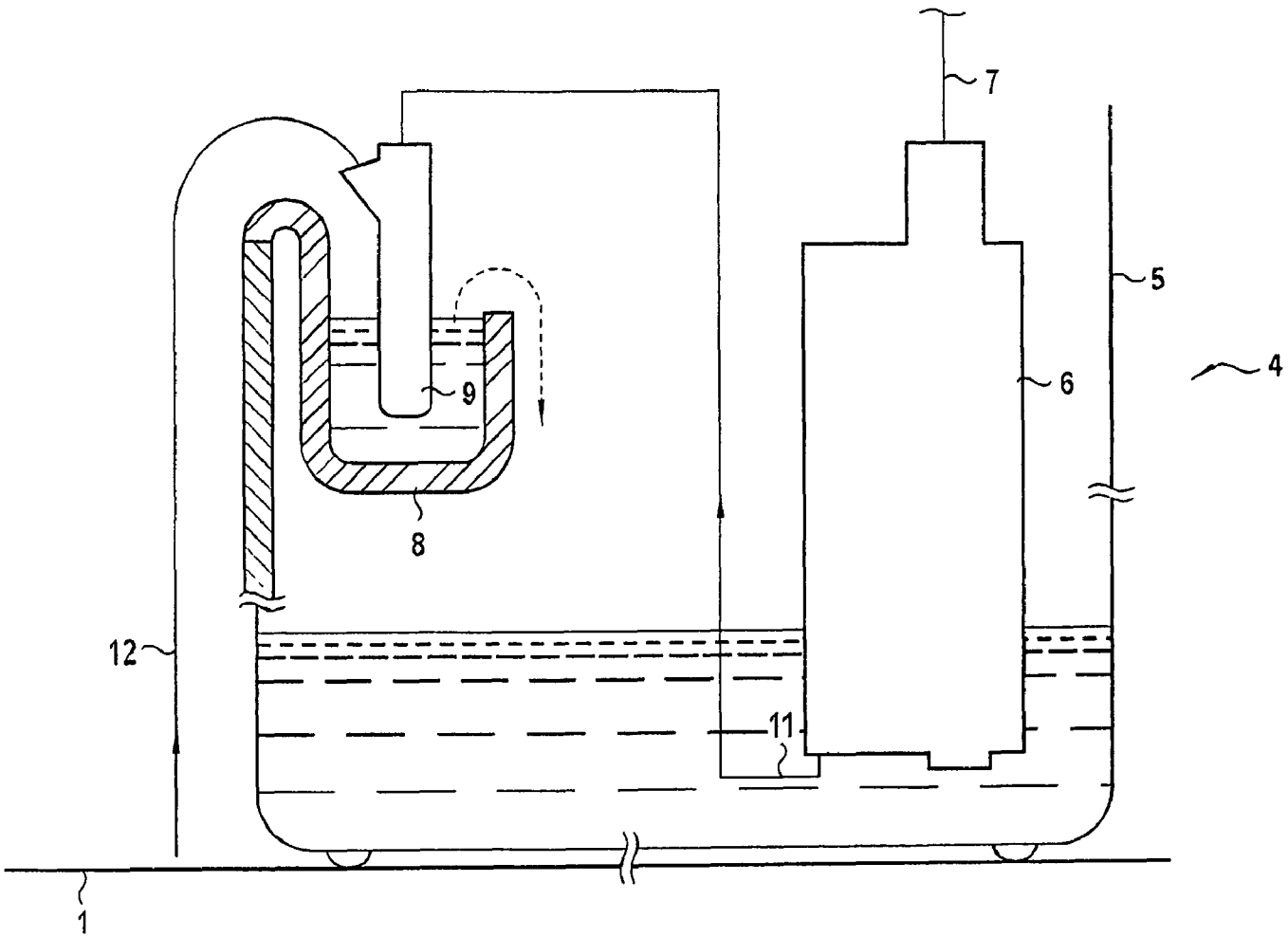

FIG. 7 shows a modified form of the arrangement of the suction jet pump according to FIG. 6. The pot 8 is fastened to the upper edge of the baffle 5. The pot 8 may in this case be arranged both inside and outside the baffle 5. The suction jet pump 9 is fastened in the pot 8 in a suitable way. It is also conceivable, however, to design the propellant lines 11 with a strength such that the suction jet pump 9 is held in the pot 8 by the propellant line 11. The strength of the propellant line 11 is achieved by means of the material of the propellant line 11 or by means of reinforcing elements, for example a wire insert.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A suction jet pump, comprising a propulsion jet nozzle with a round nozzle orifice, a mixing tube, an intake orifice, and a suction line in fluid connection arranged on the suction jet pump, wherein an outlet orifice of the mixing tube is arranged in a pot, the pot being directly connected to a side wall of a vertically oriented baffle, wherein a bottom of the pot is arranged proximate to a top of the baffle, whereby the suction jet pump does not feed against a volume confined by the baffle.

2. The suction jet pump as claimed in claim 1, wherein only the outlet orifice and only a portion of the mixing tube are arranged inside the pot.

3. The suction jet pump as claimed in claim 1, wherein the mixing tube is arranged at an angle deviating from a perpendicular axis with respect to a closed bottom of the pot.

4. The suction jet pump as claimed in claim 1, wherein the mixing tube is arranged substantially perpendicular with respect to a closed bottom of the pot.

5. The suction jet pump as claimed in claim 3, wherein the mixing tube is arranged at an angle of between 5° and 85° with respect to a perpendicular axis with respect to a bottom of the pot.

6. The suction jet pump as claimed in claim 1, wherein the pot is connected to the suction jet pump.

7. The suction jet pump as claimed in claim 6, wherein the pot is connected to the suction jet pump by means of a latch or plug connection.

8. The suction jet pump as claimed in claim 6, wherein the pot is integrally formed with the suction jet pump.

9. The suction jet pump as claimed in claim 8, wherein the pot is welded or adhesively bonded to the suction jet pump.

10. The suction jet pump as claimed in claim 6, wherein the pot is formed on a baffle or in a region of the baffle.

11. The suction jet pump as claimed in claim 5, wherein the mixing tube is arranged at an angle of between 20° and 70° with respect to a perpendicular axis with respect to a bottom of the pot.

12. The suction jet pump as claimed in claim 1, wherein an outlet orifice of the mixing tube is arranged so that an output of the mixing tube fills the pot.

13. The suction jet pump as claimed in claim 1, wherein the baffle is U-shaped.

14. The suction jet pump as claimed in claim 13, wherein the pot is coupled to the side wall at a distance from a bottom of the baffle.

15. The suction jet pump as claimed in claim 1, wherein the pot is coupled to the side wall at a point between a top and a bottom of the side wall.

* * * * *